US007121638B1

(12) United States Patent
Eggert et al.

(10) Patent No.: US 7,121,638 B1
(45) Date of Patent: Oct. 17, 2006

(54) DRAWER LATCH

(75) Inventors: Daniel M. Eggert, Kenosha, WI (US); Dean J. Iwinski, Muskego, WI (US)

(73) Assignee: Snap-on Incorporated, Kenosha, WI (US)

( * ) Notice: Subject to any disclaimer, the term of this patent is extended or adjusted under 35 U.S.C. 154(b) by 146 days.

(21) Appl. No.: 10/418,447

(22) Filed: Apr. 17, 2003

Related U.S. Application Data

(60) Provisional application No. 60/378,441, filed on May 7, 2002.

(51) Int. Cl.
*A47B 95/00* (2006.01)

(52) U.S. Cl. ..... 312/332.1; 312/333

(58) Field of Classification Search ..... 312/330.1, 312/333, 332.1, 351, 902; 292/175
See application file for complete search history.

(56) References Cited

U.S. PATENT DOCUMENTS

| | | | | |
|---|---|---|---|---|
| 1,230,115 | A * | 6/1917 | Clark | 27/35 |
| 2,689,777 | A * | 9/1954 | Wolters | 312/332.1 |
| 2,732,240 | A | 1/1956 | Hutzelman | |
| 3,107,958 | A | 10/1963 | Robbins | |
| 3,122,402 | A | 2/1964 | Bullock | |
| 3,218,112 | A | 11/1965 | Stark | |
| 3,239,298 | A | 3/1966 | McCarthy | |
| 3,252,746 | A | 5/1966 | Kafferlin et al. | |
| 3,450,453 | A | 6/1969 | Tazaki | |
| 3,501,188 | A * | 3/1970 | Korkos | 292/175 |
| 3,574,436 | A | 4/1971 | Anderson | |
| 3,969,009 | A | 7/1976 | Radek | |
| 4,653,820 | A | 3/1987 | Tazaki | |
| 4,790,579 | A * | 12/1988 | Maxwell et al. | 292/175 |
| 5,221,132 | A * | 6/1993 | Combs et al. | 312/310 |
| 5,292,191 | A * | 3/1994 | Slivon | 312/332.1 |
| 5,359,492 | A * | 10/1994 | Porter | 361/683 |
| 5,388,902 | A | 2/1995 | Huebschen et al. | |
| 5,403,139 | A | 4/1995 | Slivon et al. | |
| 5,775,140 | A | 7/1998 | Hallsten | |
| 5,868,478 | A | 2/1999 | Yemini | |
| 5,918,875 | A | 7/1999 | Masley et al. | |
| 6,375,235 | B1 | 4/2002 | Mehmen | |
| 6,386,659 | B1 | 5/2002 | Muller et al. | |
| 6,547,289 | B1 * | 4/2003 | Greenheck et al. | 292/126 |

* cited by examiner

*Primary Examiner*—Peter M. Cuomo
*Assistant Examiner*—Sarah B. McPartlin
(74) *Attorney, Agent, or Firm*—Seyfarth Shaw LLP

(57) ABSTRACT

A latch mechanism for a cabinet having a drawer slideably disposed therein and moveable between opened and closed positions. The drawer has an elongated drawer pull having an elongated latch member that is slideably disposed under the drawer pull for longitudinal sliding between latching and unlatching positions. A latch is integrally disposed on one end of the latch member and has a latch surface. A protrusion having a protrusion surface is coupled to the cabinet and disposed in a position to be in abutting relationship with the latch when the drawer is in the closed position and the latch member is in the latching position and being in non-abutting relationship when the latch member is in the unlatching position. A spring is integrally provided on the latch member and is connectable to the drawer for biasing the latch member to the latching position.

17 Claims, 5 Drawing Sheets

DRAWER LATCH

RELATED APPLICATION

This application claims the benefit of the filing date of copending U.S. Provisional Application No. 60/378,441, filed May 7, 2002.

BACKGROUND

The following disclosure relates to devices having multiple drawers, and has particular application to apparatus and methods for preventing at least one drawer from accidentally opening in a multi-drawer device, such as a cabinet or the like.

Cabinets and other multi-drawer devices are constructed so that each drawer either automatically latches when closed, requires positive operation of an actuator to be latched, or has no latch at all. Drawers in filing cabinets are usually of the former character, while drawers in rolling cabinets must be positively actuated to latch them closed. The present application deals with a latch mechanism that is placed in its latched position automatically when the drawer is closed. It should be understood that latch mechanisms are separate from key-operated locks that may be included in cabinets. This application deals with the former, not locks.

In some latch mechanisms, the actuator is pivoted or rotated between its latched and unlatched conditions. When the cabinet is of the rolling type, that is, it may be moved from place to place on its rollers, such latch mechanisms can tend to inadvertently open, particularly if the floor is uneven. Known mechanisms incorporating a sliding structure have an actuator which is grasped by the user at a particular point to open it. Certain known drawer latch mechanisms require the use of two hands, one to unlatch the mechanism and the other to grasp the drawer pull and open the drawer. Such mechanisms are unsightly because their actuators are visible.

Other sliding latch mechanisms for a cabinet drawer are known to comprise a drawer latch mechanism which is less likely to open inadvertently when the cabinet in which it is used is rolled from one place to another, such as that disclosed in U.S. Pat. No. 5,388,902. The user can grasp the latch mechanism at any point along its extent to open the drawer. The drawer latch mechanism is substantially concealed by the drawer pull. That mechanism can be unlatched and the drawer opened with one hand.

Various types of multi-drawer devices are provided with mechanisms to prevent at least one drawer from accidentally opening. However, many prior designs utilize multiple complex components and are not easily retrofitted to older multi-drawer devices without redesign of the multi-drawer devices. Examples of certain prior latching devices are shown in U.S. Pat. Nos. 5,388,902 and 5,403,139.

While some of these designs may be adequate for some uses, they tend to require the complete redesign of multi-drawer devices in order to incorporate the latching feature and are difficult to retrofit in existing multi-drawer devices.

SUMMARY

The disclosed apparatus and methods avoid some of the disadvantages of prior devices and methods while affording additional structural and operating advantages.

The latch mechanism of the present application is provided for a drawer of a cabinet including sidewalls and an integral front pull. The latch mechanism of the present application is ideal for situations where an existing cabinet requires such a latching means to be incorporated thereon as a retrofit device.

The latch mechanism comprises an elongated slide member adapted to be disposed under the front pull and slideable between a latched and unlatched position. The slide member is configured to be readily grippable by a user simply placing his fingers under the front pull. A latch is provided on one end of the slide member, which is biased into a latching position with a resilient spring member that is coupled to the cabinet. The latch may comprise a generally sloped cam surface on its distal end.

The latch mechanism of the present application further comprises a side trim piece adapted for coupling to a side member of an existing cabinet. As such, the trim piece may have complementary apertures in alignment with existing apertures on the side wall of the cabinet, for receiving therethrough a bolt or the like. An outwardly extending protrusion is coupled to the trim piece and is disposed adjacent to the drawer glide path and is adapted to coact with the latch when the latch is biased in a latched position. The protrusion further includes a cam surface that coacts with the latch cam surface when the cabinet drawer is moved into its closed position. It will thus be appreciated that the latch mechanism can be easily retrofitted onto an existing or new cabinet with minimal modifications thereof.

The latch is thus biased to coact with the protrusion of the side member by the spring. When the user desires to unlatch and open a drawer, the user simply extends his fingers beneath the front pull, thus contacting the slide member. By moving the slide member in the opposite direction of where the latch is engaged, the slide member will thus unlatch the latch from the protrusion, thus causing the spring to compress. The user can then readily open the drawer. Upon releasing the slide member, the spring urges the latch back to its latched position. When the user then closes the opened drawer, the latch cam surface coacts with the protrusion cam surface, thus causing the slide member to move in the opposite direction of where the latch is, again causing the spring to compress. When the cam surfaces cease to coact, the spring again causes the latch to return to its latched position, wherein the latch readily coacts with the protrusion, causing the drawer to be latched.

BRIEF DESCRIPTION OF THE DRAWINGS

For the purpose of facilitating an understanding of the disclosed apparatus and method, there are illustrated in the accompanying drawings embodiments thereof, from an inspection of which, when considered in connection with the following description, the disclosed apparatus and method, its construction and operation, and many of its advantages should be readily understood and appreciated.

DETAILED DESCRIPTION

The present application discloses a latching mechanism which is adaptable to be easily retrofitted to an existing or new cabinet having a slideable drawer moveable between closed and opened positions.

Figure 1:
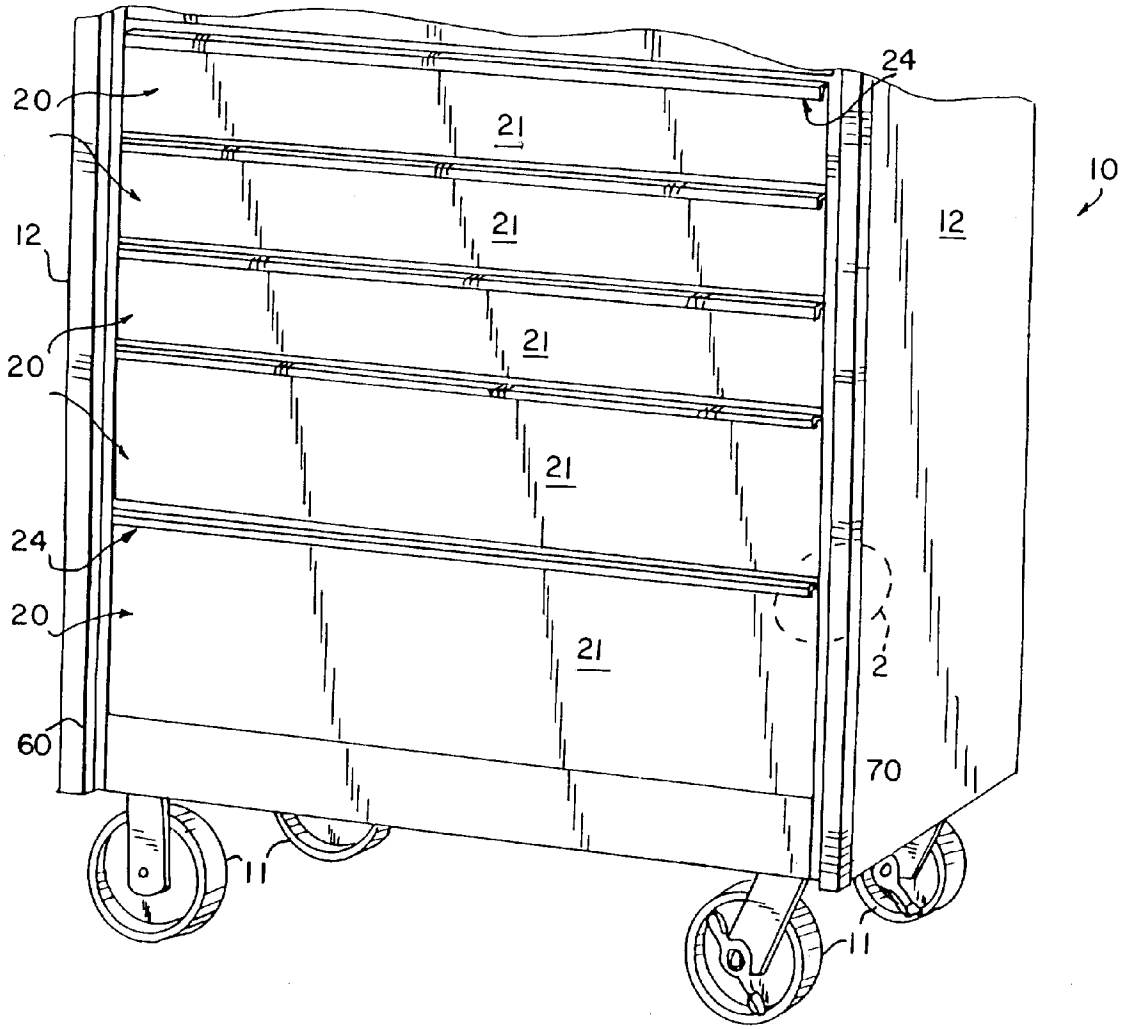
FIG. 1 is a fragmentary, perspective view of a cabinet containing a plurality of drawers and a latching mechanism in accordance with the present application.
Figure 2:
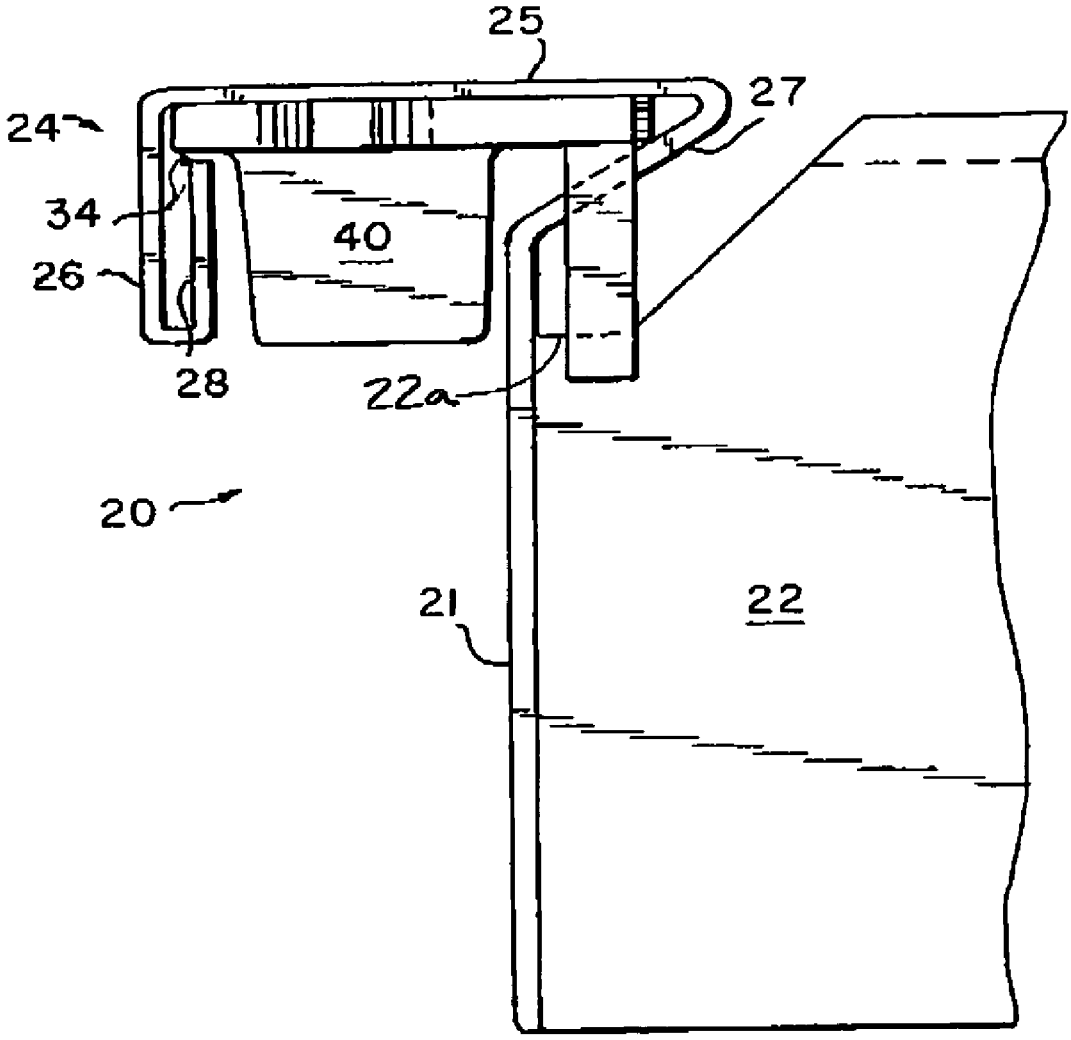
FIG. 2 is a fragmentary and elevational view on an enlarged scale, of the encircled portion of the latching mechanisms in the cabinet of FIG. 1.

Referring to FIGS. 1 and 2, there is depicted a typical tool storage cabinet 10, with which the latching mechanism of the present application may be used. The cabinet 10 may be mounted on rollers or casters 11 which enables easy mobility of the cabinet. The cabinet 10 includes two sidewalls 12 and at least one drawer 20, which slides from an open position, extending from the cabinet, to a closed position, recessed within the cabinet. Each drawer 20 has a front wall 21 and a pair of sidewalls 22. An elongated metal drawer pull 24 is located at the front end of each of the drawers 20 and extends substantially along its entire length. The drawer pull 24 may be integral with or coupled to the front wall 21. Pull 24 may include a top flange 25 and a depending, downwardly extending front flange 26. Front wall 21 may be bent rearwardly at its upper end to form an offset portion 27 which is integral with the rear end of the top flange 25.

Figure 12:
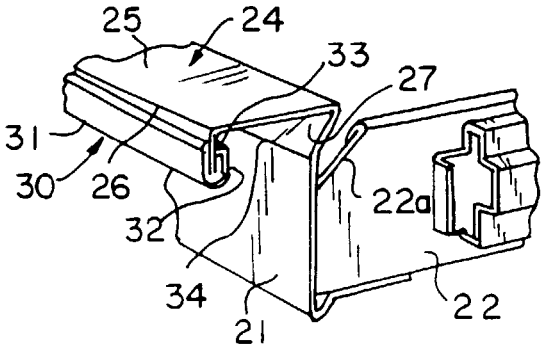
FIG. 12 is a reduced fragmentary, perspective view of an alternate drawer.

Referring to FIG. 12, in an embodiment, a trim member 30 may be disposed over the bottom portion of front flange 26 to provide an ergonomic grip for the drawer 20 or for providing better aesthetics of the cabinet 10. The trim member 30 has a front element 31 and a rear element 32, thereby defining a substantial U-shape. Near the top of the rear element 32 may be a forwardly projecting rib 33. Because of the convergence of elements 31 and 32 and their resilience, front flange 26 is frictionally gripped between element 31 and rib 33 when the trim member 30 is disposed thereon. The space between rib 33 and top flange 25 at the front, and the space defined by offset portion 27 at the rear, thereby defines a channel 34.

In another embodiment (FIG. 2), the lower end of the front flange 26 may be bent rearwardly and then upwardly to form an offset portion 28 that can function as a grip, thereby resembling a substantial U-shape and defining a channel 34. In such an embodiment, the trim member 30 may still be provided wherein element 30 would be disposed adjacent to the front flange 26 and the rib 33 is disposed adjacent to the offset portion 28, thereby frictionally retaining the trim member 30 thereon.

Figure 3:
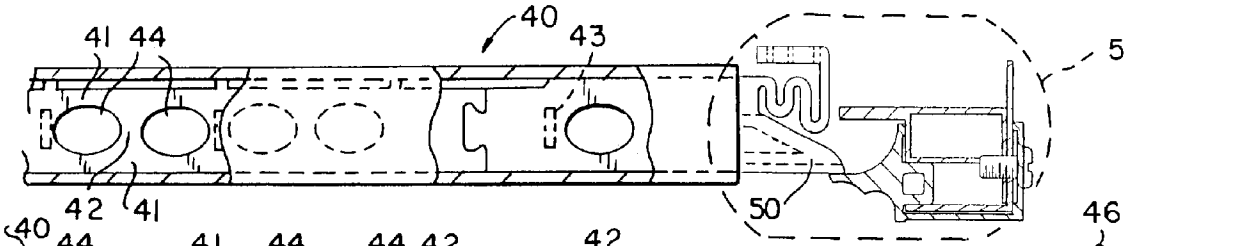
FIG. 3 is a fragmentary to plan view in partial section of a latching mechanism in the cabinet of FIG. 1.
Figure 4:
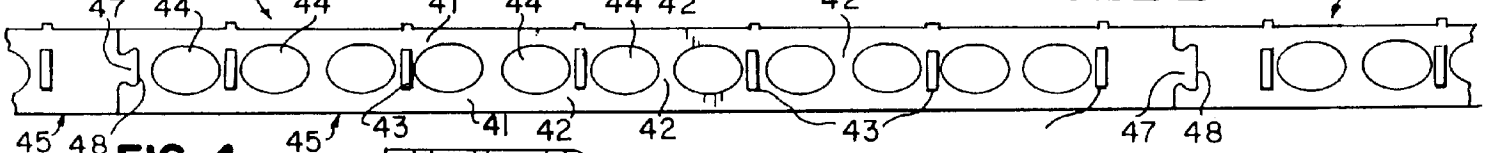
FIG. 4 is a top plan view of a latching member in the cabinet of FIG. 1.

Referring to FIGS. 3 and 4, a latch member 40 is in the form of an elongated member and, in one form, has a length substantially equal to the length of pull 24, a width slightly less than the width of top flange 25 and a thickness slightly less than the height of channel 34, wherein the latch member 40 can be slideably received within channel 34. Latch member 40 may be of ladder construction and include two or more longitudinally extending rails 41 and a plurality of parallel cross members or fingers 42. Additionally, one or more ribs 43 are located along the length of latch member 40 and, in one form, ribs 43 are located along fingers 42 or every other finger 42. Latch member 40 is slideably disposed in channel 34 and rests upon rib 33 or offset portion 28 at the front and upon offset portion 27 at the rear. Latch member 40 is constrained between top flange 25, rib 33 (or offset portion 28) and offset portion 27 and is horizontally slideable within channel 34 from side to side.

In one form, openings 44 between rail portions 41 and fingers 42 have smooth contoured surfaces without any sharp angles. For example, openings 44 can be circular, egg-shaped, or oval in order to provide a more natural and comfortable gripping surface for the user and to allow for better material flow in a molding process if latch member 40 is molded from a plastic or other suitable material.

Latch member 40 can be comprised of multiple pieces, such as one or more ladder portions 45 and a latch portion 46 that can be connected together, such as through a snap-fit or interlocking male and female dovetail connectors 47 and 48 (see FIG. 4). This allows for a latch segment to be connected to one or more ladder portions 46, depending on the length of the drawer front, which minimizes parts inventory by allowing the same components to make up variable-length latch members for use on drawers having different sizes and provides significant cost savings for latch replacement instead of complete latch member 40 replacement.

Figure 5:
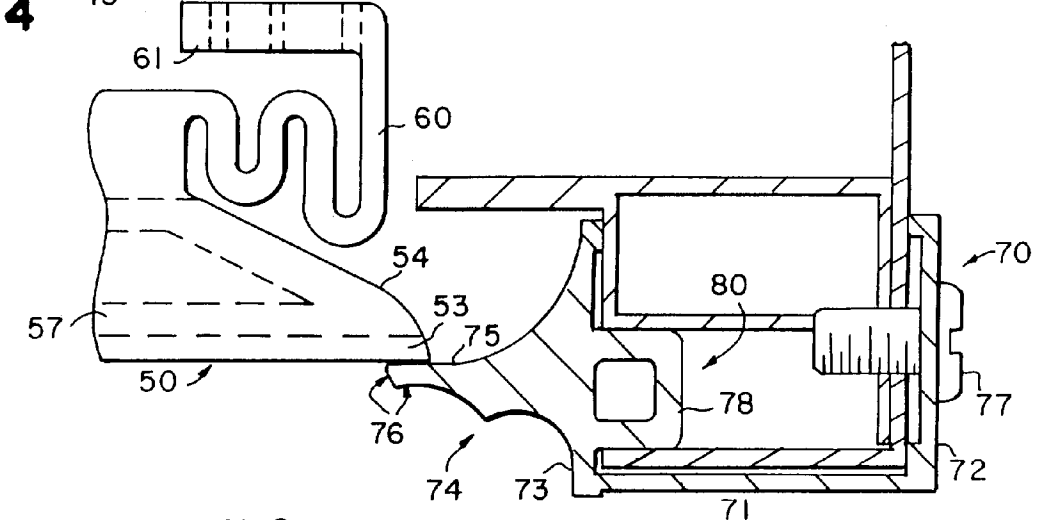
FIG. 5 is a fragmentary top plan view, in partial cross-section, on an enlarged scale, of the latching mechanism of FIG. 3.

Referring also to FIG. 5, each complete latch member 40 also has a latch 50 disposed on only one end of the latch member 40. The latch 50 may be integral, coupled or unitary with an end latch portion 46. Latch 50 has a shoulder 53 and a sloped camming surface 54. Latch 50 can be made of any suitable material. Latch 50 may include a reinforcement structure that forms a thicker portion of latch 50, such as frame 57. It will be appreciated that a separate latch portion 46 may be manufactured if it is desired to latch the drawer 20 on the opposite end, for example, for use on one of the drawers on a side-by-side double bank drawers. Such a separate latch portion 46 would merely be the mirror image of that depicted in the figures, wherein the frame 57 would be located on the opposite surface.

Figure 7:
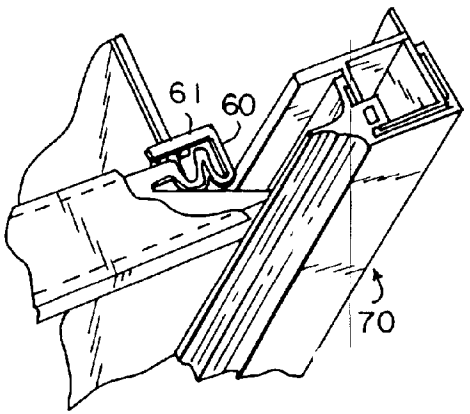
FIG. 7 is a fragmentary perspective view, in partial cross-section, of a drawer having a trim piece on the handle.

A resilient spring 60 is an extension of latch portion 46 and may be integral therewith. Spring 60 may be a serpentine spring having a plurality of bends, such as two (as in FIG. 11) or 3 (as in FIGS. 5–7). A tab 61 is coupled to latch portion 46 and may be formed on the end of spring 60. The tab 61 of the spring 60 is fixedly coupled to the side wall 22 via a notch 22*a* (see FIG. 2). When in place, tab 61 prevents spring 60 from becoming uncoupled from notch 22*a*. As such, tab 61 does not move relative to the side wall 22 during the latch mechanism's operation. Additionally, trim member 30 and/or offset portion 27 and front flange offset portion 28 also prevent latch member 40 and from becoming dislodged from channel 34.

Figure 10:
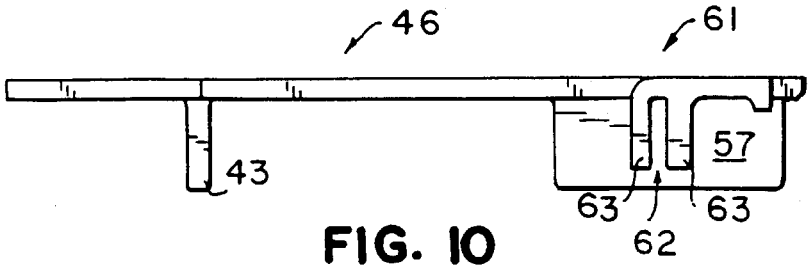
FIG. 10 is a rear elevational view of the latching portion of FIG. 8.

Referring to FIG. 10, in another embodiment, tab 61 may include a channel 62 formed between two downwardly projecting flanges 63. When in place, a portion of drawer sidewall 22 rests within the channel 62 so that flanges 63 are located on opposite sides of sidewall 22, thereby coupling the tab 61 to the sidewall 22.

Tab 61 prevents latch member 40 from becoming dislodged from channel 34 and holds spring 60 static, relative to the sidewall 22, so that latch 50 can be biased towards the latching position, for example, toward the right as depicted in the figures. Alternatively, latch 50 might not normally be biased in any direction, such that it is only when latch member 40 is moved towards the unlatched position, i.e. toward the left as depicted in the figures, that spring 60 extends and exerts a force on latch member 40 that is toward the latching position, i.e., toward the right as depicted in the figures. Thus, when the user removes his fingers from latch member 40, spring 60 biases the latch member 40 into the latching position. The operation is reversed for a left handedly disposed latch mechanism. Further, it will be appreciated that the latch mechanism of the present application can also be used in a vertical configuration. As such, it will be appreciated that the orientation references herein are for illustrative purposes only, since the latching mechanism of the present application can be oriented in any known manner.

In some cabinets 10, an aesthetic trim piece is disposed adjacent to the front wall of drawers 20 on either side and covering the front portion of both cabinet sidewalls 12. The latching mechanism provides a trim piece 70 (FIGS. 5–7) that, whether used as part of a retrofit kit for older cabinets or as part of a new cabinet, is provided on the front of cabinet 10, such as on and in front of sidewalls 12 (FIG. 1). In one form, the trim piece 70 is constructed of aluminum or any other suitable material, including a variety of plastics. Referring again to FIG. 5, trim piece 70 includes a front wall 71 and sidewalls 72 and 73. Sidewall 73 includes an outwardly extending protrusion 74 extending toward drawers 21 when assembled. Protrusion 74 includes a locking surface 75 that coacts with latch 50 when latch member 40 is biased in the latching position. One or more camming surfaces 76 may be provided adjacent to surface 75 towards the end thereof and/or opposite surface 75, for operable cooperation with the cam surface 54 to cause latch 50 to retract to the unlatching position, for at least a moment, while drawer 20 is being closed. A fastener, such as screw 77, may be used to attach trim piece 70 to the sidewall of cabinet 10. However, any other suitable fasteners, including snap-fit surfaces on trim piece 70 that interact with other snap-fit surfaces on cabinet 10, can be used. In one form, sidewalls 72 and 73 can both be fastened using one or more screws 77 (see FIG. 6). In another form, bulged out portion 78 (FIGS. 3 and 5) may be located on one or more of sidewalls 72 and 73, with bulged out portion 78 being sized to be frictionally inserted within an opening 80 formed in sidewall 12 of cabinet 10. In this case, no fasteners may be needed because of the frictional fit between bulged out portion 78 and opening 80.

In an assembled condition, latch member 40 is slideable between a normal latching position and an unlatching position. Spring 60 biases member 40 to the right, as viewed in FIG. 3, and to its latched condition. One may place one's fingers under drawer pull 24 and grip latch member 40. By moving one's hand to the left, one or more depending fingers 42 or ribs 43 are engaged by the user and the latch member 40 may be moved to the left to dispose it in its unlatched position, wherein the drawer 20 can be readily opened. Tab 61 maintains spring 60 position relative to the drawer sidewall 21 as latch member 40 is moved because of the portion of the sidewall 22 residing within channel 62 wherein the downwardly projecting flanges 63 straddle the sidewall 22. As latch member 40 is moved to the left, spring 60 extends and creates, or increases, the biasing force to the right, such that when one's fingers are removed from the latch member 40, spring 60 biases latch member 40 toward the right and into the latched position. Additionally, latch member 40 moves left when cam surfaces 54 and 76 coact while a drawer 20 is being closed, again creating or increasing the spring's biasing force to the right, wherein the latch 50 will be biased into its latched position when the cam surfaces 54 and 76 are no longer in contact, whereby the shoulder 53 readily coacts with surface 75 to latch a drawer 20 closed.

Figure 6:
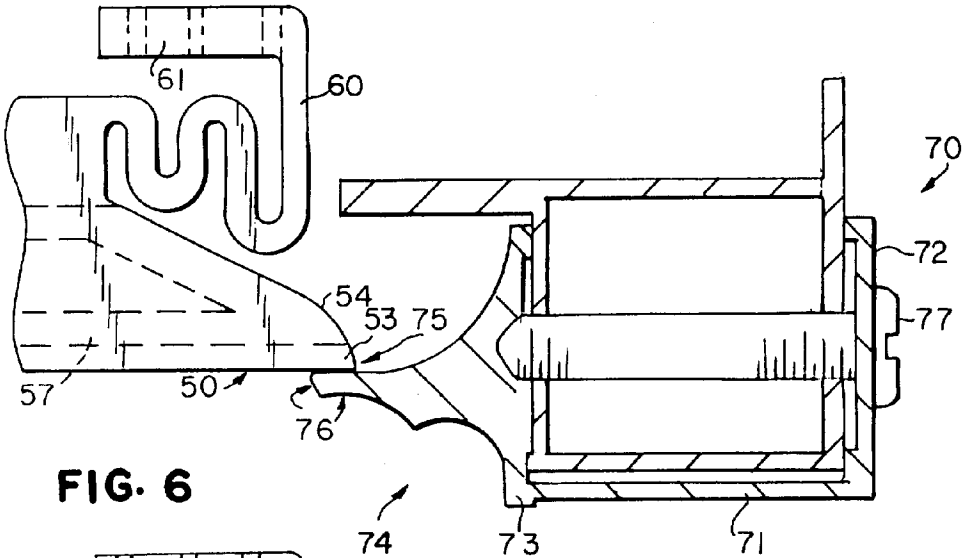
FIG. 6 is a view similar to that in FIG. 5 of a latching mechanism having an alternate trim piece.
Figure 11:
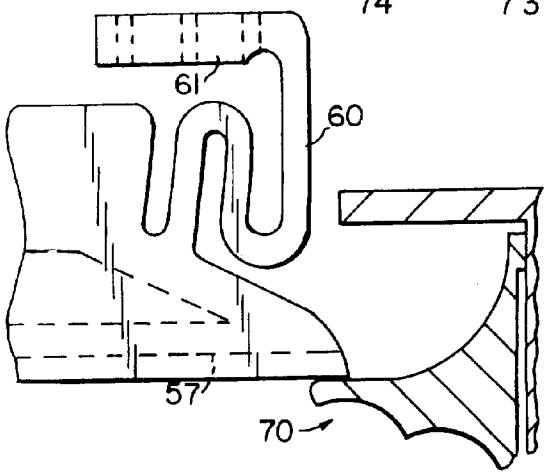
FIG. 11 is a view similar to FIG. 6 of a latching mechanism having an alternate spring.
Figure 8:
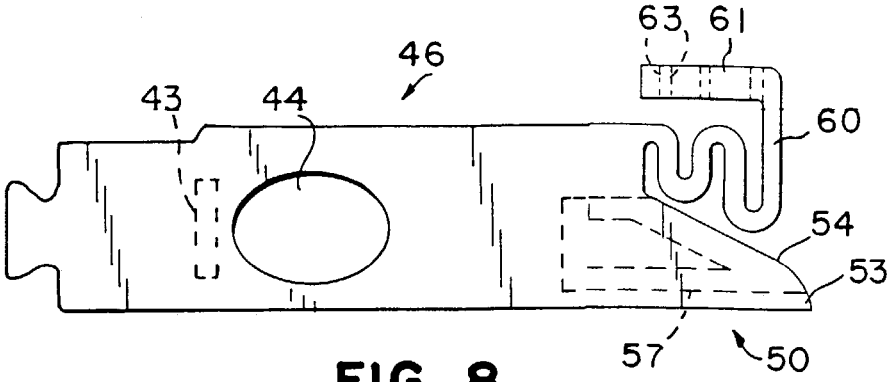
FIG. 8 is a top plan view of the latching portion of the latching mechanism of FIG. 3.
Figure 9:
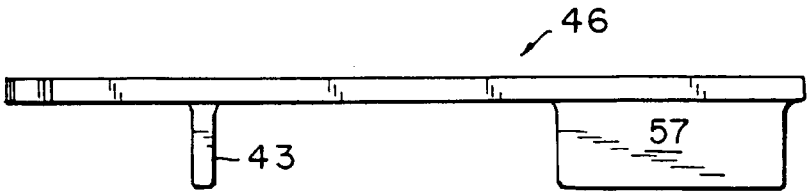
FIG. 9 is a front elevational view of the latching portion of FIG. 8.

Referring to FIGS. 5, 6 and 11, whenever drawer 20 is in its closed position, latch 50 occupies the position shown, that is, so it interferes with surface 75 of protrusion 74. Shoulder 53 is in abutting relationship with the surface 75, thereby retaining drawer 20 in its closed condition.

When it is desired to open the drawer, the user places his fingers under pull 24 of the associated drawer, whereby his fingers will contact latch member 40, as above described. Movement to the left will cause the user's fingers to engage fingers 42 or ribs 43 and move latch member 40 to the left, causing latch 50 to be withdrawn from abutting relationship with surface 75. Now the user, with his fingers against rear element 32 of trim member 30, may pull the drawer open. Latch member 40 will automatically move back to the right as soon as the user releases it by virtue of spring 60 biasing latch member 40 to the right. When the drawer is later closed, camming surface 54 engages the front of protrusion 74 (such as on camming surface 76) causing latch 50 to be pushed to the left thereby clearing protrusion 74, whereupon the drawer can be closed. Spring 60 will subsequently cause latch 50 to snap to the right, to the latched position depicted in FIG. 7.

Cabinet 10, as depicted, is on wheels or casters 11 and is adapted to be moved freely from place to place. It is important that, when the cabinet is being moved, the drawers 20 be securely latched closed, so that they do not open inadvertently. The latching mechanism described above will provide such a secured latched condition. The bouncing motion or vibrations which frequently occur if the floor on which the cabinet is being rolled is uneven would tend to unlatch a latch mechanism having an actuator that is pivoted vertically. Such bouncing or vibrations, however would have much less of an effect on the horizontally movable latch 50 described above. Moreover, the latch member 40 is concealed. It is not visible to spoil the cabinet's appearance, as seen in FIG. 1. It is constrained by the drawer pull 24 itself so that it is automatically engaged by the user who wants to open a drawer. The member 40 can be touched at any point along the drawer pull 24.

To assemble the latch mechanism, latch member 40 is aligned with channel 34 of drawer 20. It is then slid into place (FIG. 2). Tab 61 is deflected sufficiently to move it into proper position with the flanges 63 straddling a portion of drawer sidewall 22, which then resides in channel 62 to retain latch member 40 in place laterally. Latch member 40 is retained within channel 34 front-to-back and vertically by offset portion 27 and offset portion 28 or trim member 30, as best seen in FIG. 2.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

We claim:

1. A cabinet comprising:

a wall structure;

a drawer having a front wall and disposed within the wall structure and being movable between closed and opened positions relative to the wall structure;

an elongated drawer pull disposed on the front wall;

an elongated latch member disposed under the elongated drawer pull and extending substantially longitudinally thereof and being supported thereby for sliding movement between latching and unlatching positions;

a latch integral with the elongated latch member at one end thereof and having a latch shoulder;

a protrusion projecting from the wall structure having a protrusion surface and disposed in a position to be in abutting relationship with the latch shoulder when the drawer is in the closed position and the latch member is in the latching position and being in non-abutting relationship with the latch shoulder when the latch member is in the unlatching position; and a serpentine spring having a plurality of bending portions, carried by the latch member and connectable to the drawer for biasing the latch member to the latching position.

2. The cabinet of claim 1 wherein the spring is unitary with the latch.

3. The cabinet of claim 1 wherein the latch member includes a plurality of depending fingers configured to be engageable by a user's finger.

4. The cabinet of claim 1 wherein the drawer pull includes a channel disposed thereunder and defined by the front wall having a rearwardly bent upper end integral with an outwardly extending top flange terminating with a depending, downwardly extending front flange having a substantially U-shaped form defined by a portion of the front flange being bent rearwardly toward the cabinet and then upwardly terminating adjacent to the front flange.

5. The cabinet as claimed in claim 4 wherein the latch member is slidably disposed within the channel.

6. The cabinet as claimed in claim 1 wherein the latch includes a reinforcement structure.

7. The cabinet as claimed in claim 1 wherein the spring has a tab adapted to be coupled to a side wall of the drawer.

8. The cabinet as claimed in claim 1 wherein the protrusion is coupled to the wall structure by an aesthetic trim piece.

9. The cabinet as claimed in claim 1 wherein the latch includes a sloped camming surface disposed adjacent to the latch shoulder and configured to co-act with the protrusion.

10. The cabinet as claimed in claim 9 wherein the protrusion includes a protrusion camming surface disposed adjacent to the protrusion surface to co-act with the sloped camming surface when the drawer is moved from the opened to closed position.

11. The cabinet as claimed in claim 10 wherein the sloped camming surface and protrusion camming surface cooperate to move the latch member from the latching position to the unlatching position when the drawer is moved from the closed position to the opened position.

12. The cabinet as claimed in claim 1 wherein the latch member includes a plurality of interconnected portions.

13. A latch and protrusion combination for a cabinet having a wall structure and a drawer disposed within the wall structure with a front wall and being slidable between closed and open positions relative to the wall structure, an elongated drawer pull disposed on the front wall and having a channel disposed thereunder, a latch unitary with one end of an elongated latch member that is slidably disposed within the channel of the drawer pull and extends substantially longitudinally thereof and supported thereby for sliding-movement between latching and unlatching positions, the improvement comprising:

a latch shoulder defined by the latch and a sloped camming surface adjacent to the latch shoulder and disposed in a position to co-act with a protrusion projecting from the wall structure, the protrusion including a protrusion surface disposed in a position to be in abutting relationship with the latch shoulder when the drawer is in the closed position and the latch member is in the latching position and being in non-abutting relationship with the latch shoulder when the latch shoulder is in the unlatching position, wherein the sloped camming surface, and protrusion cooperate to move the latch member between the latching and unlatching positions when the drawer is moved from the opened position to the closed position.

14. The combination as claimed in claim 13 further comprising a spring carried by the latch member and connectable to the drawer for biasing the latch member to the latching position.

15. The combination as claimed in claim 13, which includes an aesthetic trim piece connected to the cabinet, wherein the protrusion is coupled to the trim piece.

16. A cabinet comprising:

a wall structure;

a drawer having a front wall and disposed within the wall structure and being movable between closed and opened positions relative to the wall structure;

an elongated drawer pull disposed on the front wall;

an elongated latch member disposed under the elongated drawer pull and extending substantially longitudinally thereof and being supported thereby for sliding movement between latching and unlatching positions;

a latch integral with the elongated latch member at one end thereof and having a latch shoulder;

a protrusion projecting from the wall structure having a protrusion surface and disposed in a position to be in abutting relationship with the latch shoulder when the drawer is in the closed position and the latch member is in the latching position and being in non-abutting relationship with the latch shoulder when the latch member is in the unlatching position; and a serpentine spring having a plurality of bending portions, carried by the latch member and connectable to the drawer for biasing the latch member to the latching position, said spring including a tab adapted to be coupled to a side wall of the drawer, said tab including a channel defined by at least two projecting flanges, the channel being adapted to couple to the side wall.

17. A latch and protrusion combination for a cabinet having a wall structure and a drawer disposed within the wall structure with a front wall and being slidable between closed and open positions relative to the wall structure, an elongated drawer pull disposed on the front wall and having a channel disposed thereunder, the combination comprising:

a latch unitary with one end of an elongated latch member that is slidably disposed within the channel of the drawer pull and extends substantially longitudinally thereof and supported thereby for sliding-movement between latching and unlatching positions, the latch having a shoulder and a sloped camming surface adjacent to the latch shoulder and disposed in a position to co-act with a protrusion on the wall structure, the protrusion including a protrusion surface disposed in a position to be in abutting relationship with the latch shoulder when the drawer is in the closed position and the latch member is in the latching position and being in non-abutting relationship with the latch shoulder when the latch member is in the unlatching position, wherein the sloped camming surface, and protrusion cooperate to move the latch member between the latching and unlatching positions when the drawer is moved from the opened position to the closed position; and a spring carried by the latch member and connectable to the drawer for biasing the latch member to the latching position, said spring including a tab having a channel defined by at least two projecting flanges adapted to be coupled to the drawer.

* * * * *